United States Patent [19]

Gebert

[11] Patent Number: 4,828,258

[45] Date of Patent: May 9, 1989

[54] SPINNING TOP GAME APPARATUS AND METHOD

[76] Inventor: Paul H. Gebert, 4 Benham Cir., Cartersville, Ga. 30120

[21] Appl. No.: 202,556

[22] Filed: Jun. 6, 1988

[51] Int. Cl.[4] ..... A63B 67/14

[52] U.S. Cl. ..... 273/1 G; 273/1 M; 273/108; 273/109; 446/257

[58] Field of Search ..... 273/108, 147, 110, 1 GE; 446/257

[56] References Cited

U.S. PATENT DOCUMENTS

| | | | |
|---|---|---|---|
| 84,865 | 12/1868 | Douglas | 273/108 |
| 459,997 | 9/1891 | Cromwell | 273/108 |
| 1,099,615 | 6/1914 | Purse | 273/108 |
| 1,317,640 | 9/1919 | Nussbeck | 273/108 |
| 2,807,470 | 9/1957 | Keuls | 273/1 G |
| 2,857,163 | 10/1958 | Lykes | 273/108 |
| 3,429,573 | 2/1969 | Cederberg | 273/108 |
| 3,815,911 | 6/1914 | Cooper | 273/108 |
| 3,906,660 | 9/1975 | Voth | 446/257 |
| 4,039,190 | 8/1977 | Kachaylo | 273/108 |

*Primary Examiner*—Richard C. Pinkham
*Assistant Examiner*—Gary Jackson
*Attorney, Agent, or Firm*—Thomas & Kennedy

[57] ABSTRACT

A spinning top game toy includes a disk-shaped playing board with three groups of upstanding pedestals mounted to the periphery of the board and a central pedestal extending upwardly from the board adjacent the center portion thereof. The upper surface of each pedestal is adapted to retain a spinning top thereon. A plurality of spinable tops are adapted to spin on the upper surfaces of the peripheral pedestals and a bonus top is adapted to spin on the upper surface of the central pedestal. The bonus top has a central spindle that has an upper surface adapted to retain a spinning top. The game is played by two or more players who, in turn, each spin the bonus top on the central pedestal and then move the spinable tops among the peripheral pedestals in a preselected sequence. Points are accumulated for successful moves of the tops until one of the tops or the bonus top stops spinning. Bonus points can be accumulated by spinning the tops on the central spindle of the bonus top in a stacked spinning configuration.

20 Claims, 2 Drawing Sheets

SPINNING TOP GAME APPARATUS AND METHOD

FIELD OF THE INVENTION

The present invention relates to game toys and more particularly to a game toy in which spinning tops are moved in a preselected sequence among a number of pedestals.

BACKGROUND OF THE INVENTION

Games of skill in which points are accumulated based upon the movements of spinning tops have been available for some time. Examples of such games are illustrated in U.S. Pat. Nos. 459,997 of Cromwell; 2,857,160 of Lykes; 3,429,573 of Cederberg; and 4,039,190 of Kachaylo. While doubtless interesting to play, most of the prior art spinning top games require only minimal skill and present only a single degree of difficulty to players. As a result, proficient players can become bored upon achieving the required skill level while inexperienced or younger players are often unable to compete with more experienced or older players.

Consequently, there exists a place for a spinning top game toy that is fun to play, presents increasing levels of difficulty to players as the game progresses and effectively handicaps more proficient players so that less experienced players can compete successfully. It is to the provision of such a game that the present invention is primarily directed.

SUMMARY OF THE INVENTION

The present invention is a game of dexterity in which spinning tops are moved in a preselected sequence among a number of pedestals having concave upper surfaces to retain the tops. A preferred embodiment includes four tops of successively larger diameter and a bonus top having a diameter larger than any of the four tops. The pedestals are mounted around the periphery of a playing board and are arranged into three groups of increasing complexity. A centrally located pedestal is adapted to retain the spinning bonus top.

The bonus top and the largest of the four tops include a central spindle that has a concave upper surface such that other tops can be spun thereon. A squib top having numerals printed around its periphery is rotatably mounted to the playing board adjacent a pointer such that one of the numerals is indicated by the pointer when the squib top stops after being spun.

The game is played by two or more competing players. Each player begins his turn by spinning the bonus top on the centrally located pedestal and then spinning the four tops on the first and least complex group of peripheral pedestals. If all four tops and the bonus top are spinning simultaneously, the player has completed step 1 of the game. He then moves to steps 2 and 3 by selectively removing the tops from the first group of pedestals and respinning them on the second and third groups. The degree of difficulty increases with each successive group such that increased skill is required to spin the tops as a player progresses through the game. Points are accumulated for each successive move of a top until one of the tops or the bonus top stops spinning and falls from its pedestal signalling the end of the player's turn.

If a player accumulates less than 3 points in a turn, he can elect to spin the squib top and receive the score indicated thereon in place of his earned score. In this way, less experienced or younger players can compete successfully with older or more experienced players.

If a player successfully completes all three levels of play, he can earn bonus points by spinning the bonus top on the central pedestal, spinning the fourth top on the spindle of the bonus top and spinning one of the remaining tops on the spindle of the fourth top in a stacked spinning configuration. If the three stacked spinning tops continue to spin for a predetermined length of time, bonus points are added to the player's score and his turn is over.

Thus, a spinning top game is provided that is fun to play and that presents increasing degrees of difficulty to a player as he progresses through his turn so that experienced players do not tend to become bored with the game. Further, younger or inexperienced players are provided with an equalizing advantage through the use of the squib top such that they can compete successfully with older or more proficient players. Other advantages, objects and features of the invention will become apparent upon reading the following specification in conjunction with the accompanying drawings.

DESCRIPTION OF THE PREFERRED EMBODIMENT

Figure 1:
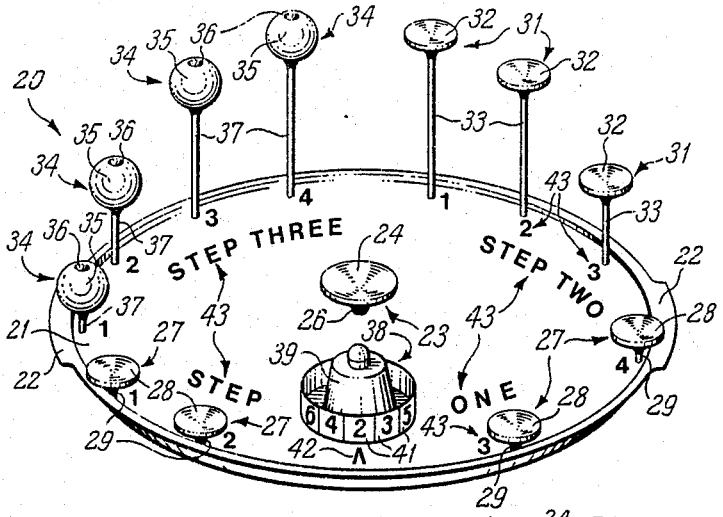
FIG. 1 is a perspective view of one embodiment of a playing board according to the present invention.

Referring now in more detail to the drawings in which like numerals represent like parts throughout the several views, FIG. 1 shows a playing board 20 constructed according to the present invention. The board 20 has a generally flat disk-shaped base member 21 that includes a pair of opposed peripheral handles 22. A substantially centrally located pedestal 23 extends upwardly from the playing board 21 and includes a stem 26 mounted to the board and a concave upper surface 24 for retaining the spinning bonus top.

A first group of upstanding pedestals 27 is mounted to the playing board 21 adjacent its periphery as shown. Pedestals 27 include stems 29 mounted to the board and concave upper surfaces 28 for retaining a spinning top. A second group of pedestals 31 is mounted to the playing board 21 adjacent its periphery with the pedestals 31 including stems 33 and concave upper surfaces 32. The stems 33 are of successively increasing length such that the upper surfaces 32 of the second group of pedestals are arranged in a stair-step configuration as shown.

A third group of pedestals 34 include stems 37 mounted to the board 21 and generally spherical upper portions 35. The tops of the spherical upper portions 35 have small concave depressions 36 for retaining a spinning top. The concave depressions 36 are preferably much smaller than the upper surfaces of the first and second groups of pedestals such that the difficulty of spinning a top on the third group of pedestals is greater than for the first and second groups. Further, a top spun in the depressions 36 tends to spin for less time than on the first and second groups of pedestals further increasing the difficulty of spinning tops on the third group of pedestals. It has been found that upper surface diameters of approximately 1 inch for the first, two groups of pedestals and concave depression diameters of approximately ¼ inch for the third group provides a desirable difficulty difference.

A squib top 38 is rotatably mounted to the base member 21 adjacent a pointer 42. The squib top 38 includes a central spindle 39 and has a plurality of numerals 41 printed around its periphery. When the squib top is spun, it eventually stops spinning with the pointer 42 pointing to one of the peripheral numbers 41. The squib top provides a method for randomly selecting a numeral from among the peripheral numerals.

Indicia 43 are printed on the base member 21 to indicate the preselected sequence in which spinning tops are moved among the pedestals. A numeral printed adjacent each pedestal indicates which of the four spinable tops is spun on that pedestal and the words "Step 1", "Step 2", and "Step 3" indicate the various levels of play.

Figure 2:
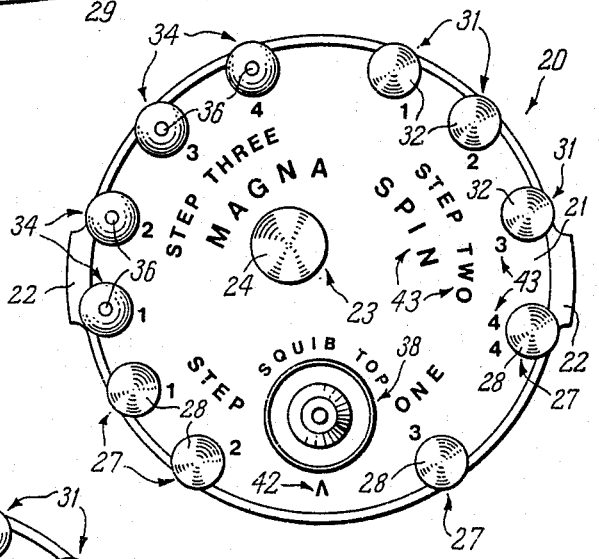
FIG. 2 is a plan view of the playing board shown in FIG. 1.

FIG. 2 is a plan view of the playing board 20 showing the relative placement of the pedestals and the squib top . The peripheral pedestals are spaced apart varying distances to accommodate tops of various diameters. The central pedestal 23 is located adjacent the center of the base member 21 and is spaced from the peripheral pedestals so that the bonus top 51 (FIG. 4) spinning on the central pedestal does not interfere with tops spinning on the peripheral pedestals.

Figure 3:
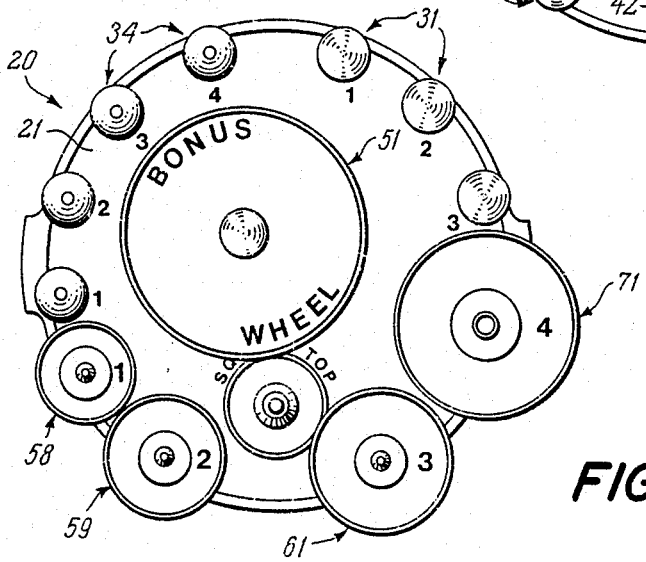
FIG. 3 is a plan view of the playing board with the four tops and the central bonus top shown spinning on the first group of pedestals.

FIG. 3 illustrates the playing board 20 as it appears with the tops spinning on the first group of pedestals and the bonus top spinning on the central pedestal. In the preferred embodiment, spinable top 58 has the smallest diameter and bears the numeral 1. Spinable tops 59, 61 and 71 have successively larger diameters and bear numerals 2, 3, and 4, respectively. The bonus top 52 has the largest diameter and is adapted to spin on the centrally located pedestal as shown.

Figure 4:
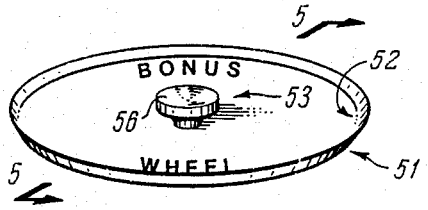
FIG. 4 is a perspective view of the bonus top.
Figure 5:
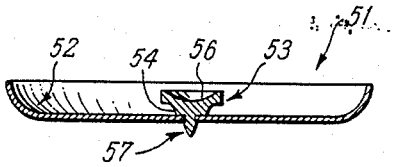
FIG. 5 is a cross-sectional view of the bonus top taken along line 5—5 of FIG. 4.

FIGS. 4 and 5 illustrate the bonus top 51 that is adapted to spin on the centrally located pedestal 23. The bonus top 51 is seen to be generally disk shaped with an upturned peripheral portion 52. A spindle 53 is mounted to the bonus top 51 at its center and extends upwardly therefrom. The spindle 53 includes a concave upper surface 56 for retaining a spinning top. Further, spindle 53 is formed from a ferrous material such as steel such that it is magnetically attractive. Tip 57 depends from the center of the bonus top. The bonus top is spun by grasping the spindle 53 and spinning the bonus top on its tip 57.

Figure 6:
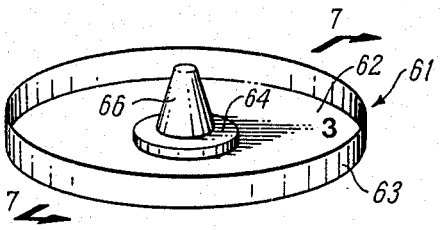
FIG. 6 is a perspective view of one embodiment of a top according to the present invention.
Figure 7:
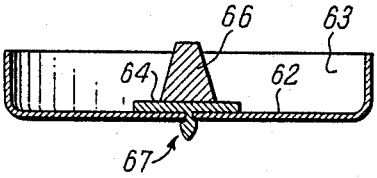
FIG. 7 is a cross-sectional view of the top taken along line 7—7 of FIG. 6.

FIGS. 6 and 7 illustrate spinable top 61 (FIG. 3). Tops 58 and 59 have different diameters than top 61 but are constructed in the same way. The top 61 is seen to be generally disk shaped with a circular base portion 62 and an upstanding peripheral wall 63. Mounted to the center of the base 62 is a disk shaped magnet 64 with a spindle 66 extending upwardly from the center portion of the magnet. A tip 67 upon which the top is spun depends from the center of the base 62. The tip 67 is preferably constructed of ferrous material so that magnetic lines of force from the magnet 64 are conducted therethrough.

Figure 8:
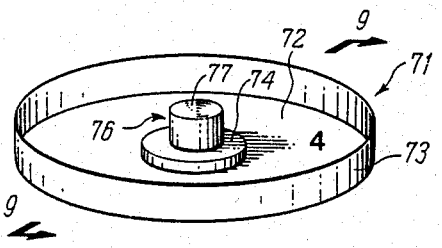
FIG. 8 is a perspective view of the largest of the tops.
Figure 9:
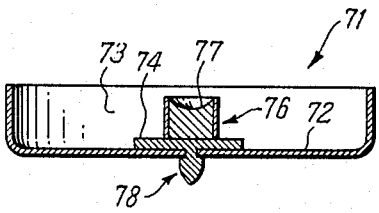
FIG. 9 is a cross-sectional view of the largest top taken along line 9—9 of FIG. 8.

FIGS. 8 and 9 illustrate spinable top 71. This top also has a circular base 72 and upstanding peripheral wall 73. A disk-shaped magnet 74 is mounted to the center of the base and a preferably ferrous tip 78 depends from the center of the base. The spindle 76 of spinable top 71 extends upwardly from the center of the magnet 74 and includes a concave upper surface 77 for retaining a spinning top. The spindle 76 is preferably formed from a ferrous material such as steel so that a magnet is attracted thereto.

It has been found that the diameters of the tops and the spacings of the pedestals should be chosen to provide at least one-half inch clearance between each spinning top and adjacent tops and pedestals. In this way, the pedestals and tops to not interfere with the motion of a top spinning on adjacent pedestals.

Figure 10:
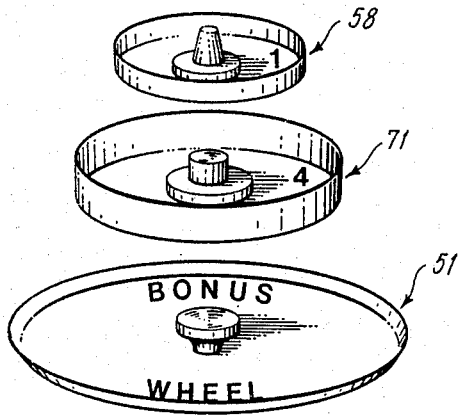
FIG. 10 is a perspective exploded view of the bonus top and two other tops as they appear in their stacked bonus configuration.

FIG. 10 illustrates a stacked configuration of tops and the bonus top in which top 71 is spun on the upper surface of the bonus top spindle and top 58 is spun on the concave upper surface of the spindle of top 71. This stacked spinning arrangement of tops is a configuration that can add bonus points to a player's score as described hereinbelow.

OPERATION

The game toy of the present invention is played by two or more players. Each player begins his turn by spinning the bonus top 51 on the upper surface 24 of the centrally located pedestal 23. The four tops are then spun on the upper surfaces 28 of the first group of pedestals 27 with the top bearing the numeral 1 being spun on pedestal number 1 and so forth. The player accumulates one point for each successful spin so that when all four tops and the bonus wheel are spinning on their respective pedestals, the player has accumulated four points. If a player accumulates three or fewer points, he can choose to spin the squib top 38 and receive the number of points indicated by the pointer 42 in place of his earned score. Upon spinning the squib top, the player's turn is over and control passes to the next player. The squib top provides a means whereby younger or less experienced players unable to earn more than three points can compete simultaneously and successfully with older or more experienced players.

Upon successful completion of the first step of the game, a player can earn bonus points if desired by selectively removing each of the spinning tops from its group one pedestal, respinning it on the upper surface of the bonus top spindle for a count of 5 and returning it to its group one peripheral pedestal. Two bonus points are accumulated for each such maneuver that is completed with all four tops still spinning. If a top stops spinning or falls during the optional bonus round, the player's turn is over and control passes to the next player. Should the player not wish to take this risk, he can move directly to step 2 rather than attempting bonus points.

Upon successful completion of step 1 and the bonus round if attempted, the player proceeds to step 2 by selectively removing the spinning tops from the pedestals 27 and respinning them on the second group of pedestals 31. Top 71 bearing numeral 4 is left spinning on its pedestal and tops 58, 59 and 61 are removed from their group one pedestals and respun on pedestals 1, 2 and 3 of the second group of pedestals. The player accumulates two points for each successful maneuver. As always, should a top fall or stop spinning, the player's turn is over. The stair-step configuration of the second group of pedestals presents an increased level of difficulty to the player such that more skill is required to spin the tops on the second group of pedestals than on the first.

Upon successful completion of step 2, the player proceeds to step 3 by selectively removing the spinning tops from their respective step two pedestals and respinning them on the third group of pedestals 34. One point is accumulated for each such maneuver completed with all tops spinning such that a total of four additional points can be earned if all four tops and the bonus top are spinning at the end of step 3. The spherical upper portions of the third group of pedestals and the small concave depressions in which the tops are spun present a further increased level of difficulty to a player who has reached the third level of play.

Upon successful completion of all three levels of play, the player has earned one attempt to accumulate bonus points with a "super bonus triple". This is done by removing all the tops and the bonus top and laying them beside the game board. The bonus top is then respun on the central pedestal and the top 71 is spun on the concave upper surface of the bonus top spindle. Finally, either top 58, 59 or 61 is spun on the concave upper surface of the spindle of top 71 to form the stacked spinning configuration illustrated in the exploded view of FIG. 10. In this configuration, the magnet mounted to top 71 is attracted to the ferrous spindle of the bonus top 51 and the magnet mounted to the additional top is attracted to the ferrous spindle of top 71 such that the stacked spinning tops do not tend to be slung from the spindles as they spin.

With all three tops spinning in the stacked configuration of FIG. 10, the player counts out loud to 15 and if, at the end of the count, the tops are still spinning, the player accumulates bonus points equal to the total of the numerals printed on the stacked tops. The number of bonus points accumulated, for example, by spinning top 58 on top 71 as illustrated in FIG. 10 is 1+4 or 5 bonus points.

Upon successful completion of the "super bonus triple", the player's turn is over and control passes to the next player. Each player in turn accumulates points in the above described way until all players have taken a turn. The player with the highest score at the end of the game is declared the winner and a new game can be started.

The invention has been described in terms of a preferred configuration of pedestals and a preferred sequence of spinning top maneuvers. It will be obvious that other sequences of top maneuvers to enhance the difficulty of the game can be followed, and the principles of the invention apply equally to other configurations of tops and pedestals and to other sequences of moves such that many obvious changes, additions and deletions can be made to the preferred embodiment without departing from the spirit and scope of the invention as set forth in the claims.

What is claimed is:

1. A game comprising:

a board having a plurality of spaced surfaces positioned thereon with each of said surfaces being adapted to retain a spinning top;

an additional surface spaced from said plurality of surfaces and being adapted to retain a spinning top;

a plurality of spinable tops adapted to spin on said plurality of spaced surfaces and;

an additional spinable top adapted to spin on said additional surface, said additional top having a centrally located surface for retaining a spinning top;

said plurality of spaced surfaces and said additional surface comprising the top portions of a plurality of pedestals extending upwardly from said board.

2. The game of claim 1 wherein said board is substantially disk shaped and wherein said plurality of spaced surfaces are positioned adjacent the periphery of the board.

3. The game of claim 2 wherein said additional surface is substantially centrally positioned on said board.

4. The game of claim 1 wherein each of said plurality of spinable tops comprises a substantially disk shaped body having a centrally located spindle extending upwardly therefrom and a centrally positioned tip depending therefrom whereby said spindles can be grasped and said tops spun on said tips.

5. The game of claim 3 wherein said plurality of spinable tops have different diameters.

6. The game of claim 6 wherein at least one of said spinable tops has a magnet centrally positioned thereon.

7. The game of claim 7 wherein said plurality of surfaces and said additional surface are formed from nonferrous material.

8. The game of claim 8 wherein said centrally located surface of said additional spinable top is formed from ferrous material.

9. The game of claim 1 wherein at least one of said spindles has an upper surface adapted to retain a spinning top.

10. The game of claim 1 further comprising means for randomly selecting a number from a plurality of possible numbers.

11. The game of claim 10 wherein said means comprises a spinable squib top positioned on said board, said squib top having a plurality of numbers printed on the periphery thereof and said board including a stationary pointer located adjacent to and pointing toward said squib top periphery.

12. A spinning top game toy comprising:

a substantially circular board having a central portion and a peripheral portion;

a plurality of pedestals extending upwardly from said board peripheral portion with each of said pedestals having an upper surface adapted to retain a spinning top;

an additional pedestal extending upwardly from said board central portion and having an upper surface adapted to retain a spinning top;

a plurality of spinable tops adapted to spin on said plurality of pedestals with said spinable tops having substantially disk shaped bodies and having different diameters:

an additional spinable top adapted to spin on said additional pedestal with said additional spinable top being substantially disk shaped and having a centrally positioned surface adapted to retain a spinning top.

13. The game toy of claim 12 wherein at least some of said pedestals extend upwardly from said board a greater distance than other of said pedestals.

14. The game toy of claim 12 wherein at least one of said plurality of spinable tops includes a centrally positioned magnet.

15. The game toy of claim 14 wherein at least some of said pedestals are formed from non-ferrous material and said centrally positioned surface of said additional spinable top is formed from ferrous material.

16. The game toy of claim 12 wherein the upper surfaces of said pedestals are concave.

17. The game toy of claim 16 wherein at least one of said concave upper surfaces is more concave than the other concave upper surfaces.

18. The game toy of claim 12 wherein at least one of said plurality of spinable tops has a centrally positioned surface adapted to retain a spinning top.

19. The game toy of claim 12 further comprising means for randomly selecting a value from a plurality of possible values, said means comprising a spinable squib wheel having a plurality of values printed on the periphery thereof and wherein said board includes a stationary pointer adjacent to and pointed toward said squib wheel.

20. A method of playing a spinning top game comprising the steps of:

providing a plurality of spinable tops;

providing a plurality of surfaces with each surface adapted to retain a spinning top;

providing an additional spinable top having a centrally positioned surface adapted to retain a spinning top;

spinning the tops on at least some of the surfaces;

spinning the additional top on one of the surfaces;

selectively removing the spinning tops from the surfaces and spinning them on other of the surfaces and on the centrally positioned surface of the additional spinning top in a preselected order;

incrementing a score upon each successful move of a top until one of the spinning tops or the additional spinning tops stops spinning;

comparing the score to the scores of other players with the player having the highest score being declared the winner of the game.

* * * * *